US005544747A

United States Patent [19]

Horn

[11] Patent Number: 5,544,747

[45] **Date of Patent: *Aug. 13, 1996**

[54] MAGNETIC HOLDERS FOR CYLINDRICAL OBJECTS

[76] Inventor: Billy L. Horn, 1313 Greenbrier, Rapid City, S. Dak. 57701

[ * ] Notice: The term of this patent shall not extend beyond the expiration date of Pat. No. 5,456,359.

[21] Appl. No.: 394,591

[22] Filed: Feb. 27, 1995

Related U.S. Application Data

[63] Continuation-in-part of Ser. No. 232,369, Apr. 25, 1994, Pat. No. 5,456,359.

[51] Int. Cl.[6] ..... B65D 85/70

[52] U.S. Cl. ..... 206/378; 206/350; 206/443; 206/818; 211/70.6; 211/DIG. 1

[58] Field of Search ..... 206/350, 378, 206/818, 443; 211/706, DIG. 1; 335/285

[56] References Cited

U.S. PATENT DOCUMENTS

| | | | |
|---|---|---|---|
| 563,787 | 7/1896 | Moyer | 335/285 X |
| 2,958,019 | 10/1960 | Scholten et al. | 335/285 |
| 3,213,335 | 10/1965 | Bourne | 206/818 X |
| 3,405,377 | 10/1968 | Pierce | 206/378 X |
| 5,080,230 | 1/1992 | Winnard | 206/350 |
| 5,313,181 | 5/1994 | Negus | 335/285 |
| 5,316,143 | 5/1994 | Horn | 206/378 |
| 5,343,181 | 8/1994 | Negus | 335/285 |
| 5,456,359 | 10/1990 | Horn | 206/378 |

FOREIGN PATENT DOCUMENTS

| | | | |
|---|---|---|---|
| 0006139 | 3/1912 | United Kingdom | 335/285 |
| 0789632 | 1/1958 | United Kingdom | 335/285 |

*Primary Examiner*—Bryon P. Gehman

*Attorney, Agent, or Firm*—John R. Duncan; Frank D. Gilliam

[57] ABSTRACT

A holder for supporting magnetic cylindrical tools of varying diameter such as wrench sockets, drill bits, etc. in order. A member having a series of recesses having shapes corresponding to the tools to be held is backed by an elongated magnet. In one embodiment, the .member is a non-magnetic material and the magnet is made up of a plurality of transverse magnetic regions, having alternately north and south pole regions on the surface toward the recesses, with the lines between adjacent north and south regions aligned with the centerline of the recesses and a narrow non-magnetized region separating each pair of adjacent magnetic regions. In a second embodiment, the member is formed from a magnetic a U-shaped sheet with the recesses formed in opposed sidewalls. The magnet is held between the sidewalls below the recesses and has two longitudinally arranged north and south poses at the surface toward the recesses, with the pole line running longitudinally along the center of the magnet and a narrow non-magnetized region is interposed along the line between the magnetic regions. A third embodiment has a corrugated backing plate faced with the alternating magnetic regions. A fourth embodiment has a solid plastic holder with individual magnet assemblies inserted at the bottom of each of a series of recesses.

23 Claims, 4 Drawing Sheets

MAGNETIC HOLDERS FOR CYLINDRICAL OBJECTS

This is a continuation-in-part of copending application Ser. No. 08/232,369 filed on Apr. 25, 1994, now U.S. Pat. No. 5,456,359.

BACKGROUND OF THE INVENTION

This invention relates in general to holders for cylindrical tools and the like and, more specifically, to a magnetic holder for sets of wrench sockets, drill bits and other cylindrical magnetic metal tools having uniformly changing diameters through the set.

A very wide variety of holders' have been developed for maintaining sets of tools and the like in a desired order on a support means. Where the objects to be held in place are formed from a magnetic metal, magnets are often employed to hold the objects in the desired order on a support. Often, spaced magnets or strips of magnetic material are mounted on a vertical surface so that magnetic material objects placed thereagainst will be held in place. Typical such arrangements are described by Dunkelberger et al. in U.S. Pat. No. 2,966,992 and Case in U.S. Pat. No. 2,457,032. These holders, however, do not maintain the objects being held in any particular order and often the magnets have insufficient strength to hold the objects in place, especially where the holder is moved or bumped.

A number of different magnetic holders have been developed for holding wrench sockets on a holder in order of decreasing (or increasing) socket diameter. Bars with holes having diameters corresponding to the decreasing diameter of sockets in a set have been provided with magnets at the bottoms of the holes to hold sockets in the holes, as described by Pierce in U.S. Pat. No. 3,405,377. While useful where the holes extend downwardly or horizontally, the magnets often do not have sufficient strength to hold the sockets in place when the holder is moved or inverted since they contact only narrow end rims of the sockets.

In order to increase the magnetic holding strength, magnets have been arranged along slots in a knife blade holder to contact and attract both sides of a knife blade, as shown by Labelle in U.S. Pat. No. 4,497,412. While useful with knives of different lengths, but reasonably uniform blade thickness, this arrangement is not easily adaptable to objects of varying thickness or diameter.

Holders using a series of uniform spaced troughs with a relatively weak magnet behind the troughs to help hold objects in the troughs are disclosed by Moyer in U.S. Pat. No. 563.787 for holding writing pens. Magnetic forces are quite weak with the poles of the magnet at one end of the holder, so that magnetic strength decreases significantly toward the other end of the holder.

Many prior holders for sets of wrench sockets use an elongated magnet along which the sockets can be placed, such as those shown by Anderson in U.S. Pat. No. 4,802,580 and Miller in U.S. Pat. No. 4,591,817. These holders do not provide anything to maintain the sockets in the desirable regular pattern of decreasing (or increasing) diameter, and the magnets contact only a small part of the sockets so that the retaining strength is low, often per, hitting sockets to be inadvertently dislodged from the holder.

Thus, there is a continuing need for a holder for cylindrical objects of varying diameter, such as wrench sockets, drill bits and the like, which maximizes magnetic forces holding the objects in place and provides a configuration that assures that the objects will be held in a selected order by diameter.

SUMMARY OF THE INVENTION

The above-noted problems, and others, are overcome by a holder for cylindrical objects of varying diameter which basically comprises a series of transverse partially-cylindrical recesses that increase in diameter (or, looking from the opposite end, decrease in diameter) along the holder, with a magnet adjacent to the bottom of each recess to hold cylindrical magnetic objects, such as a wrench sockets, drill bits, threading taps or the like in place. In each embodiment, a pole line region where north and south poles of adjacent magnets abut is located at the bottom of each recess. Preferably, a small nonmagnetic region is provided between the adjacent north and south pole regions.

In one embodiment, the holder is made from a non-magnetic material in the form of a strip in which the recesses are formed. The magnet is arranged with alternate north and south pole areas at the surface adjacent to the recesses, with the interfaces between north and south poles aligned with the centers of the recesses to provide maximum magnetic holding power. Optimally, narrow non-magnetic areas are provided between adjacent north and south poles. The strip is preferably bounded by sidewalls and end walls that add rigidity and provide a channel in the side opposite the recesses for holding the magnet in place. Transverse apertures are preferably provided in the bottom of each recess so that the magnet can be positioned very close to an object in the recess, substantially in contact with the object.

In a second embodiment, a generally U-shaped channel of magnetic metal is provided, with upstanding side walls connected by a bridging bottom wall therebetween. The recesses are formed in the sidewalls. A magnet is provided along the bottom wall, positioned so that the exposed magnet surface is closely adjacent to, or substantially in contact with, an object positioned in a recess. The magnet preferably has two adjacent north and south poles on the upper and lower surfaces, divided longitudinally of the magnet. Optimally, the adjacent north and south poles are separated by a thin non-magnetic strip. This magnet orientation, in conjunction with the magnetic metal side walls, has been found to greatly increase and concentrate the magnetic forces holding a magnetic metal objects in the recesses.

In a third embodiment, a thin flexible magnet is bonded to a corrugated magnetic metal backing plate to form the holder assembly, the, corrugations varying in width to accommodate different items to be supported. Where the metal backing plate is sufficiently stiff, no additional structure is required. If desired, side walls may be provided along the long sides of the assembly for further support. The holder of this embodiment may be secured to a structure in any suitable manner, such as nails or screws through the recesses, adhesive bonding with a liquid adhesive, double-stick tape or the like, small magnets on the back of the backing plate, etc.

In a fourth embodiment, the support structure is in the form of a solid body, typically formed from plastic or plastic foam, with a flat lower surface and a recessed upper surface. As before, the recesses are in the form of a linear series of preferably approximately circular cross section transverse recesses. An opening at the bottom of each recess is filled with a magnet assembly comprising two stacked magnets having the north pole region of one magnet adjacent to the south pole region of the other. For optimum performance, a thin non-magnetic region is interposed between the adjacent north and south pole regions. Typically, the body may be formed by injection molding. This holder may be mounted on supporting surfaces in any suitable manner, typically using nails, screws, adhesives, double-stick tape, magnets on the lower body surface, etc.

Accordingly, it is an object of this invention to provide a new and improved holder for cylindrical metal objects such as wrench socket,, drill bits, threading taps and the like of the sort that are stored in sets having regular increasing diameters from smallest to largest.

Another object of the invention is to maximize the magnetic attraction of magnetic metal objects to the holder while permitting easy and convenient removal and return of the objects.

A further object of the invention is to provide a holder which can be magnetically mounted on metal structures in a variety of orientations, stored in tool boxes and the like and moved without disengaging objects from the holder.

Yet another object of the invention is to provide a magnetic holder for holding cylindrical magnetic metal objects in spaced recesses wherein the magnetic attraction of the object to the holder is maximized.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
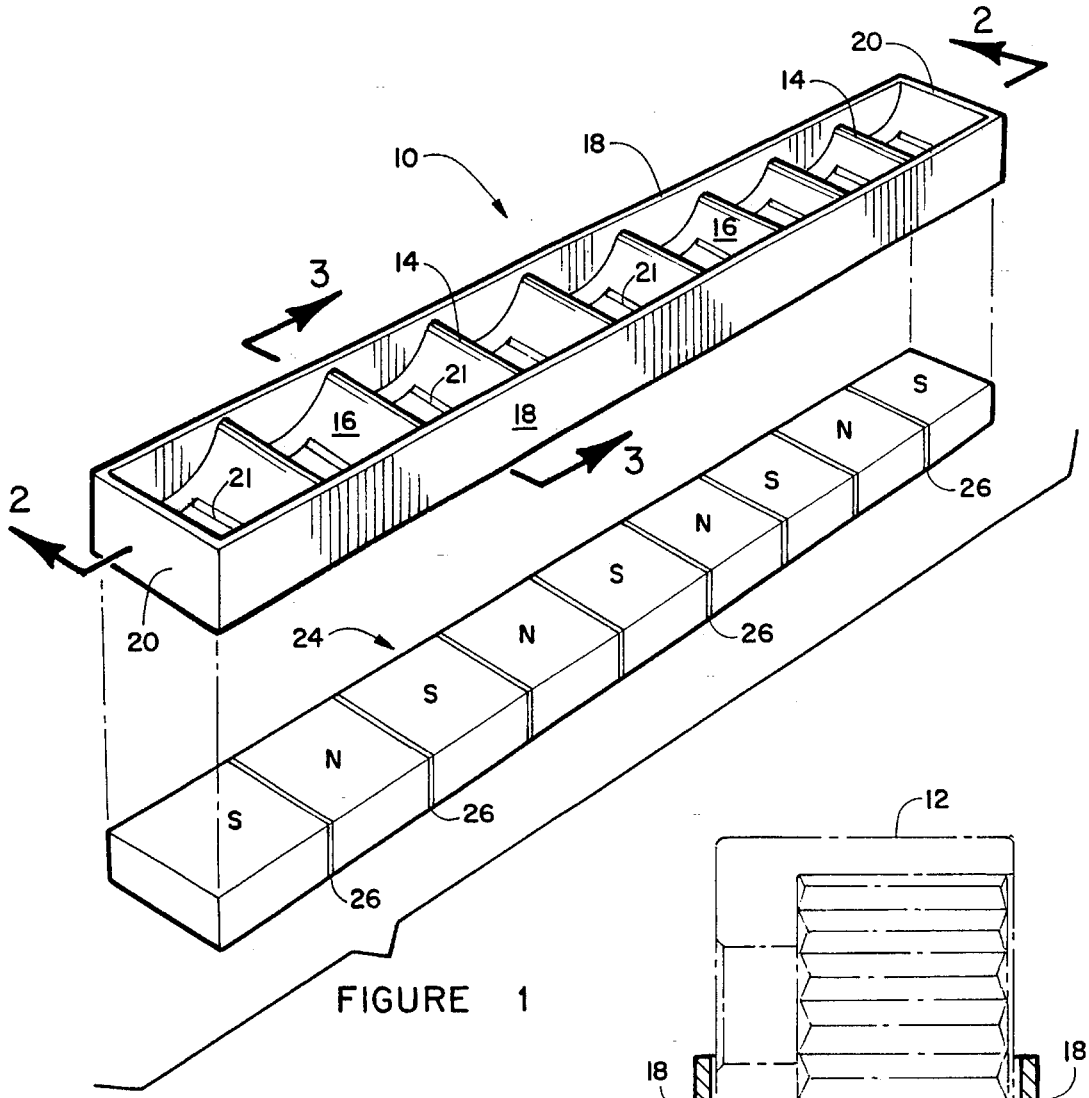
FIG. 1 is a schematic exploded perspective view of one embodiment of the cylindrical object holder of this invention.
Figure 3:
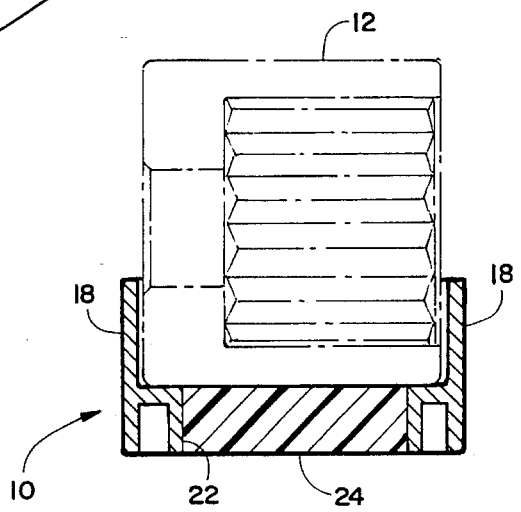
FIG. 3 is a section view taken on line 3—3 in FIG. 1.
Figure 2:
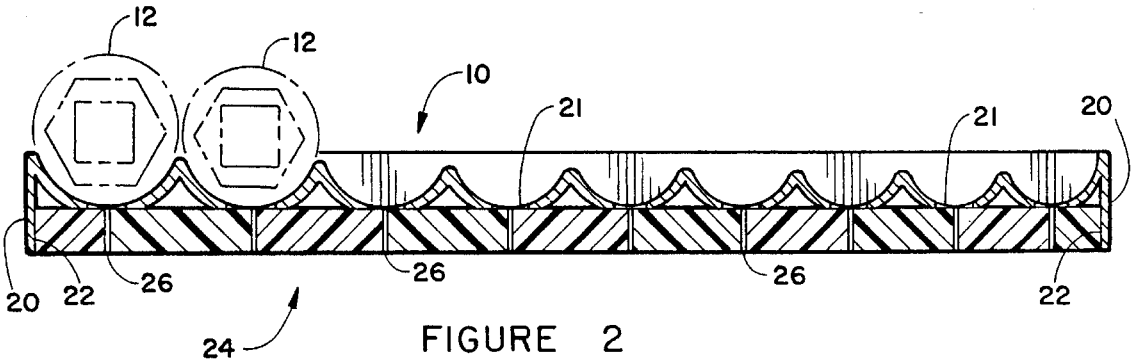
FIG. 2 is a section view taken on line 2—2 in FIG. 1.

Referring to FIGS. 1–3, there is seen a holder 10 adapted to hold a series of cylindrical objects 12, such as wrench sockets, drill bits, threading taps and the like, of increasing (or decreasing, depending on the point of view) diameter. For purposes of illustration, conventional wrench sockets are illustrated in FIGS. 2 and 3 as representative of objects 12. Generally, holder 10 is rectangular in shape, although it could be trapezoidal where the objects 12 have regularly varying lengths, such as drill bits. In the embodiment shown, holder 10 includes a strip 14 formed in a series of partial-cylindrical recesses 16, side walls 18 and end walls 20. The distance between side walls 18 will be selected in accordance with the length of the objects to be stored. The distance between end walls 20, and the radius of recesses 16, will be determined in accordance with the diameters of the objects to be stored and the number of objects to be stored.

Holder 10 may be formed by any suitable method. Injection molding is preferred for simplicity and ease of manufacture. While any suitable non-magnetic material may be used for holder 10, a thermoplastic or thermosetting plastic such as polypropylene, styrene, acrylic, nylon or the like is preferred. The material may include colorants, fillers, reinforcements such as glass fibers, etc. as desired.

A channel 22 is provided within side walls 18 and end walls 20 at the base of holder 10 to receive and support a magnet 24. Magnet 24 may be held in place in any suitable manner, such as by a tight friction fit or by adhesive bonding using a conventional adhesive such as an epoxy, silicone or cyanoacrylate adhesive.

An elongated transverse aperture 21 is provided at the bottom of each recess so that the magnet upper surface will be closely spaced adjacent to an object in the recess, or ideally substantially in light contact with the object. As best seen in FIG. 2, the edges of apertures 21 are tapered to lie along the upper surface of magnet 24.

Magnet 24 has a series of discrete areas or regions with alternating north and south poles at the upper surface (the lower surface, of course, having the opposite pattern of poles). In the embodiment of FIGS. 1–3, pole lines 26 are located in a plane that includes the axis of the recess 16 (and, inherently, the axis of the object to be held in the recesses) and lies perpendicular to the length of holder 10. I have found that this focusses the strength of the magnet at the line of contact between the magnet and the object producing maximum holding power.

For best results with maximum magnetic attraction to the stored objects, a narrow non-magnetic region is interposed between each adjacent north and south poles at pole lines 26. For optimum results, this non-magnetic region should have a thickness of from about 0.020 to 0.100 inch. Where the cylindrical objects are small in diameter, so that the distance between succeeding pole lines is small, the non-magnetic region optimally will have a thickness toward the narrow end of the above range.

Magnet 24 may be any suitable magnet material, including ceramic, metallic and flexible magnet materials. Preferably, magnet 24 is formed from a conventional flexible magnet of the sort having magnetizable barium ferrite particles dispersed in a rubbery matrix. Such materials are available from the Arnold Engineering Company and RJF International Corporation. The alternate areas having north and south poles at the top surface may be formed in a sheet of homogeneous flexible magnetic material by magnetizing strips of appropriate widths (the widths decreasing with decreasing recess diameters) along a web having a width corresponding to the length desired for magnet 24. The desirable very narrow non-magnetic regions between poles at each north-south pole interface are easily provided during the magnetizing process. Then the web is sliced transversely to provide a magnet having the elongated configuration shown.

Figure 7:
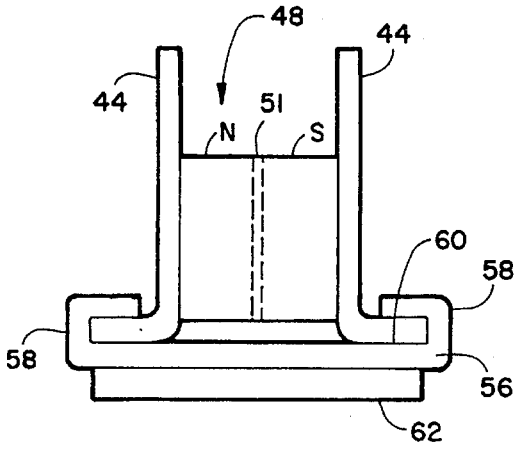
FIG. 7 is an end elevation view, taken generally from the right end as seen in FIG. 4.

Magnet 24 may be a homogeneous material which is magnetized with one pole along one top surface longitudinal edge and the opposite pole along the other top surface edge, with a narrow non-magnetized region between adjacent north and south pole regions, as shown in FIG. 7, Alternately, a strip of flexible magnetic material having the same pole on each side could be cut along the pole lines 26 as shown, then alternate pieces could be turned over to provide the desired pattern. Such pieces could be adhesively bonded to for a unitary magnet 24. Thin strips of non-magnetized material can be placed between adjacent pieces to provide the desirable thin non-magnetized interfaces or the piece edges could be coated with a non-magnetized material to provide interface layers.

The lower surface of magnet 24 is exposed, so that holder 10 can be held to a magnetically attractable metal, such as a steel shelf, work bench, tool box or the like. Because of the strength of the magnets when used with pole lines 26 arranged as shown, the holder may be mounted vertically or even inverted without risk of involuntary separation of objects from the holder.

Figure 4:
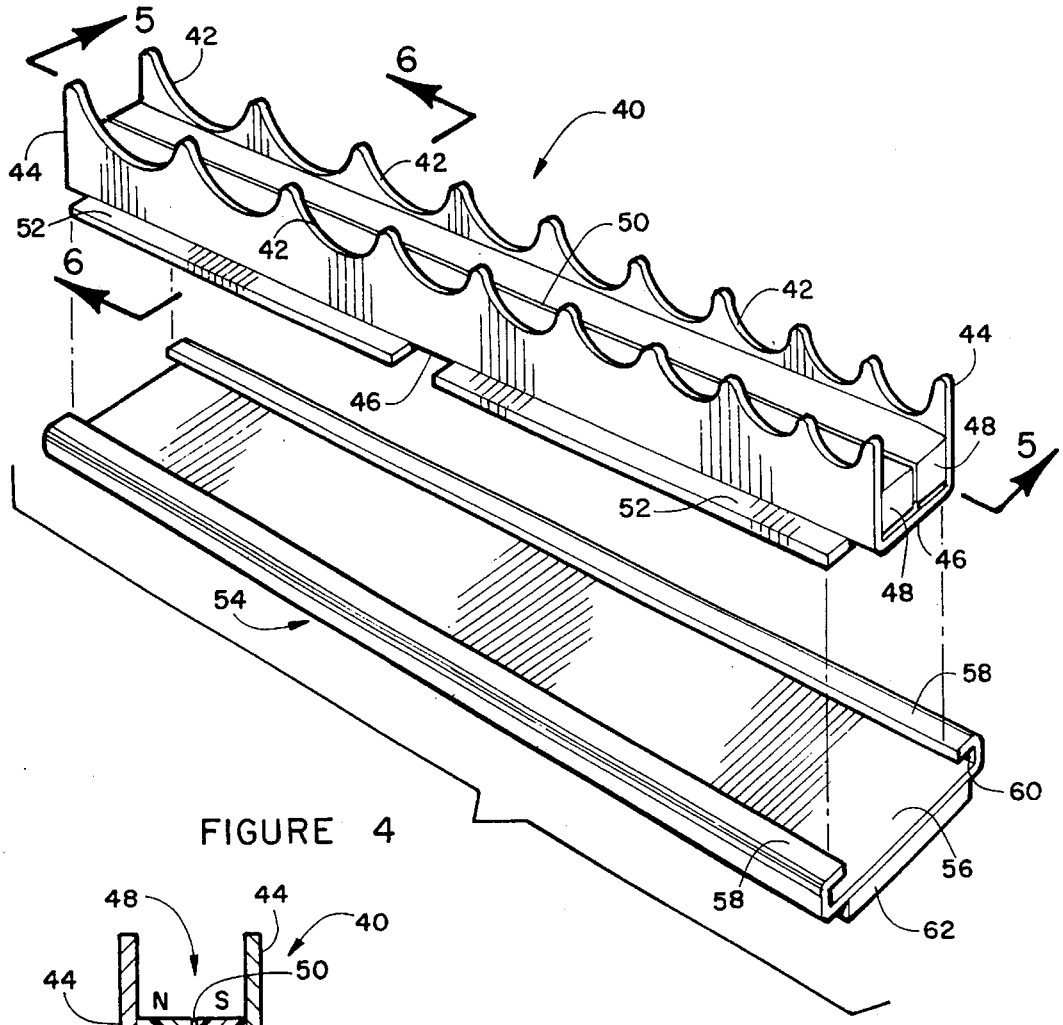
FIG. 4 is a schematic exploded perspective view of a second embodiment of the cylindrical object holder of this invention.
Figure 6:
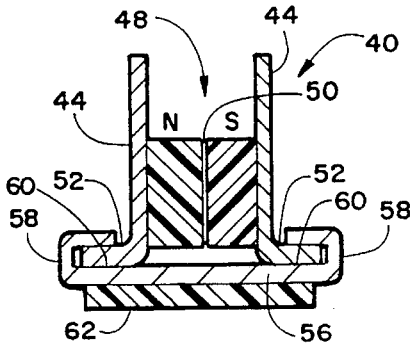
FIG. 6 is a section view taken on line 6—6 in FIG. 4.
Figure 5:
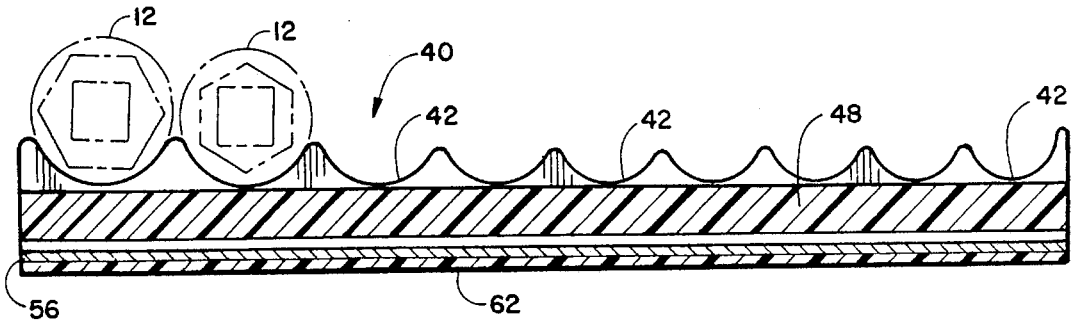
FIG. 5 is a section view taken on line 5—5 in FIG. 4.

A second embodiment of the holder of this invention is shown in FIGS. 4–6. Holder 40 here is in the form of a magnetizable metal channel with a generally U-shaped configuration. Recesses 42 having circular configurations corresponding to the cross section of the objects to be supported are formed across both sidewalls 44. A bridging wall 46 closes the bottom of holder 40.

An elongated magnet 48 is positioned in holder 40 with the upper surface of magnet 48 substantially aligned with, and tangent to, the bottom of each recess 42. Magnet 48 may be formed from any suitable magnet material, as detailed above and may be held in place in any suitable manner, such as by friction, adhesive bonding, screws through side wall 44, etc.

A pole line 50 extends longitudinally down the center of magnet 48, with one side having the north pole at the top and the other side have the south pole at the top, with a vertical pole line down the center. Preferably, a thin layer, typically having a thickness of from about 0.020 to 0.100 inch, is placed or formed between the north and south pole sides. In conjunction with the magnetizable metal sidewalls 44, the central pole line provides very high magnetic forces holding magnetic metal objects in recesses 42. While the described arrangement with two magnets 48 having opposite poles at the top and a non-magnetic region between them, any other suitable magnet configuration may be used, if desired. For example, a single magnet with either its north or south pole at the top or a magnet with any suitable pattern of alternating north and south pole regions along the top surface may be used, as detailed below.

Portions of tile base of holder 40 are cut and bent outwardly, forming flanges 52. Bridging wall portions 46 remain to maintain sidewalls 44 is position. If desired, holder 40 can be fastened to a wall, under a shelf, etc. by drilling holes in flanges 52 and inserting screws therethrough. However, it is preferred that a base 54 having a flat center 56 and folded edges 58 having a slot 60 therealong corresponding to flanges 52 be used. Base 54 may be made from any suitable non-magnetic material, such as aluminum or a rigid plastic. Flanges 52 can be slid into slot 60 and held in place by friction. If desired, countersunk screws, double-stick adhesive tape or the like could be used to hold base 54 to a wall, shelf or other surface while permitting holder 40 to be installed or removed as desired. In a preferred arrangement, a thin flexible magnet strip 62 is secured to the underside of base 54, such as by adhesive bonding. Then the assembly of holder 40 and base 54 can be easily attached and removed from any magnetic metal surface.

If desired, bridging wall 46 and flanges 54 may be omitted and the holder 40 could be an assembly of two magnetic metal sidewalls having recesses 42 and magnet 48, with this assembly pressed into a plastic channel tray, typically an extruded channel. In order to make picking up the tray without dislodging sockets or the like in place on the holder, outwardly extending flanges can be provided at the upper edge of the extruded channel or from the sides of the metal sidewalls.

The embodiment of FIGS. 4–6 is especially suitable for holding elongated cylindrical tools having varying diameters, such as drill bits, threading taps and the like, in addition to wrench sockets.

As illustrated in FIG. 7, the magnet in the overall embodiment shown in FIGS. 4–6 may be formed from a single solid piece of magnetic material, with the top along one longitudinal side being a north pole and the top along the other longitudinal side being a south pole and having a narrow central non-magnetic strip 51, formed in situ as described above.

Figure 8:
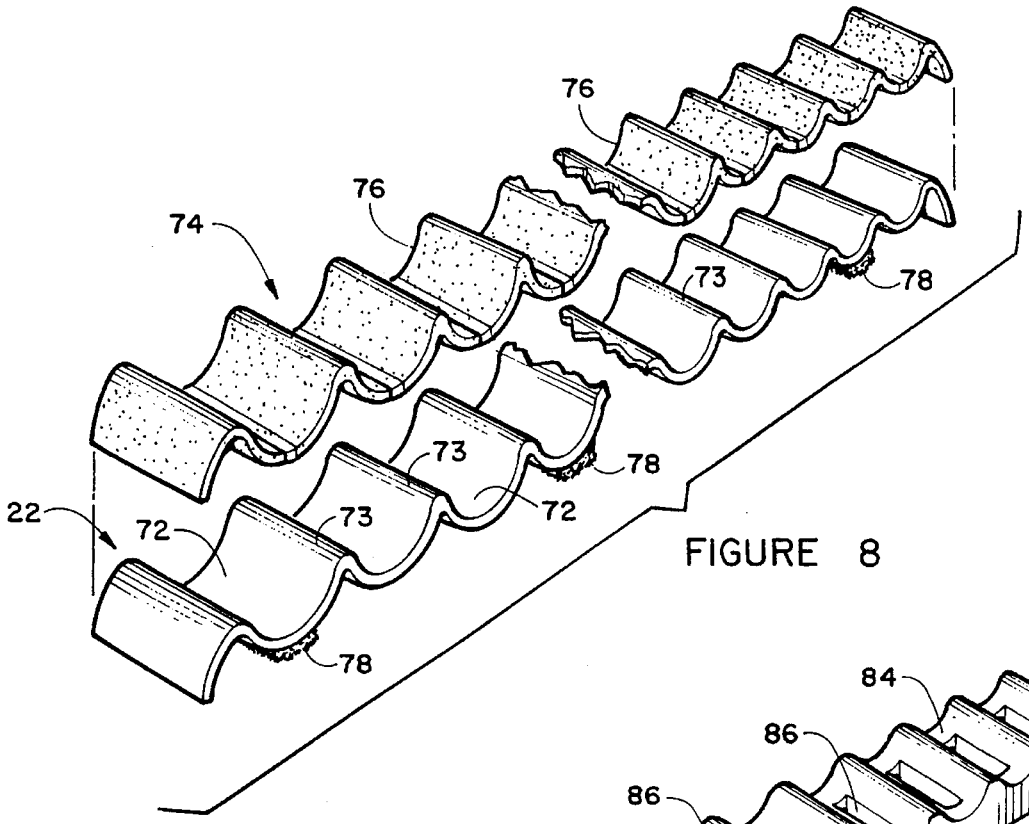
FIG. 8 is an exploded perspective view of a third embodiment.

A third, particularly simple, embodiment of the holder of this invention is shown in FIG. 8. Here, a backing plate 70 of a magnetic metal, preferably steel, is formed into corrugations providing a series of alternating recesses 72 and ridges 73. A strip of magnet material 74 is bonded to the upper surface of backing plate 70, typically with a pressure sensitive adhesive. If desired, rather than the preferred continuous strip of material 74, the magnet material can comprise a plurality of small pieces, corresponding to the portions of the strip 74 that lie along recesses 72, each piece placed in and bonded to a recess 72. While magnet material 74 can have any suitable thickness, for best results a thickness of from about 0.1 to 0.3 inch is preferred. Material 74 is divided into a plurality of contiguous magnets 76, each a separate magnet. At the bottom of each recess the north pole region of one magnet meets the south pole region of the adjacent magnet.

For optimum performance, a narrow non-magnetic region is interposed between the adjacent north and south pole regions. The preferred non-magnetic region dimensions are as detailed above in conjunction with the earlier embodiments. Magnets 76 may be formed any suitable manner. As described above, the magnets may be assembled from individual pieces or may be formed by magnetizing the different areas of a strip of material.

The embodiment of FIG. 8 may be mounted on a support, such as a wall or workbench, in any suitable manner. One preferred method is to apply double-stick tape 78 at selected locations along the lower surface of the assembly, with the exposed tape surface protected by comer sheets. The covers are removed and the assembly pressed against the mounting surface. Any other mounting means, such as nails, screws, small magnets fastened in place of tape 78, etc. may be used as desired.

If desired, sidewalls may be secured to backing plate 22 by welding, adhesive bonding, etc, to give an appearance similar to that of the embodiment of FIG. 1. In that case, the plan view of the holder would usually be trapezoidal, to accommodate longer, wider tools e.g. sockets at one end with decreasing sizes along the holder.

Figure 9:
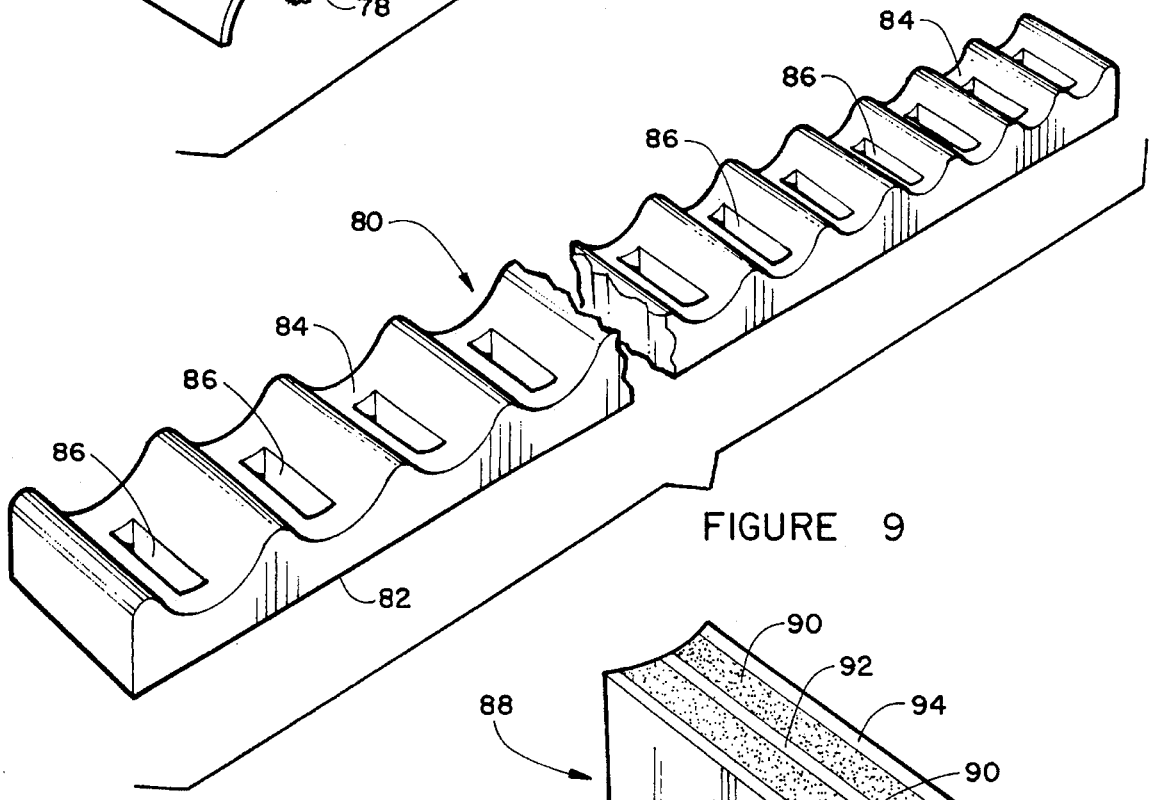
FIG. 9 is an exploded perspective view of a fourth embodiment.

Another embodiment of the holder is shown in FIG. 9. The holder 80 in this case is a solid block of plastic, plastic foam or the like, having a generally flat bottom 82 and a series of top surface recesses 84. An opening 86 is provided for receiving a magnet 88 at the bottom of each recess. Any suitable material may be used for holder 80, formed in any suitable manner. Typical plastics include acrylics, polyolefins, vinyls and the like. The holder may be formed from a solid plastic material or a foam, which may have a continuous skin formed over the surface. Cavities 86 are preferably formed during the molding process.

Figure 10:
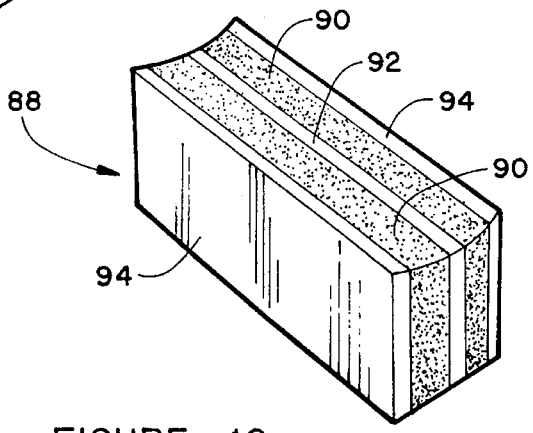
FIG. 10 is a perspective view of a magnet assembly for use in the embodiment of FIG. 9.

A preferred magnet for use with the embodiment of FIG. 9 is shown in FIG. 10. Two magnets 90 are positioned with the north pole region of one toward the south pole region of the other. While those regions may be in contact if desired, preferably a thin non-magnetic layer 92 is provided between the magnets. The preferred characteristics and dimensions for non-magnetic layer 92 are as described in conjunction with FIG. 1, above. Two magnetic metal plates 94, preferably formed from steel, are placed on the outside of the magnet assembly to greatly increase magnet strength. The magnet assembly may be held together by any suitable means, such as adhesive bonding, etc.

Figure 11:
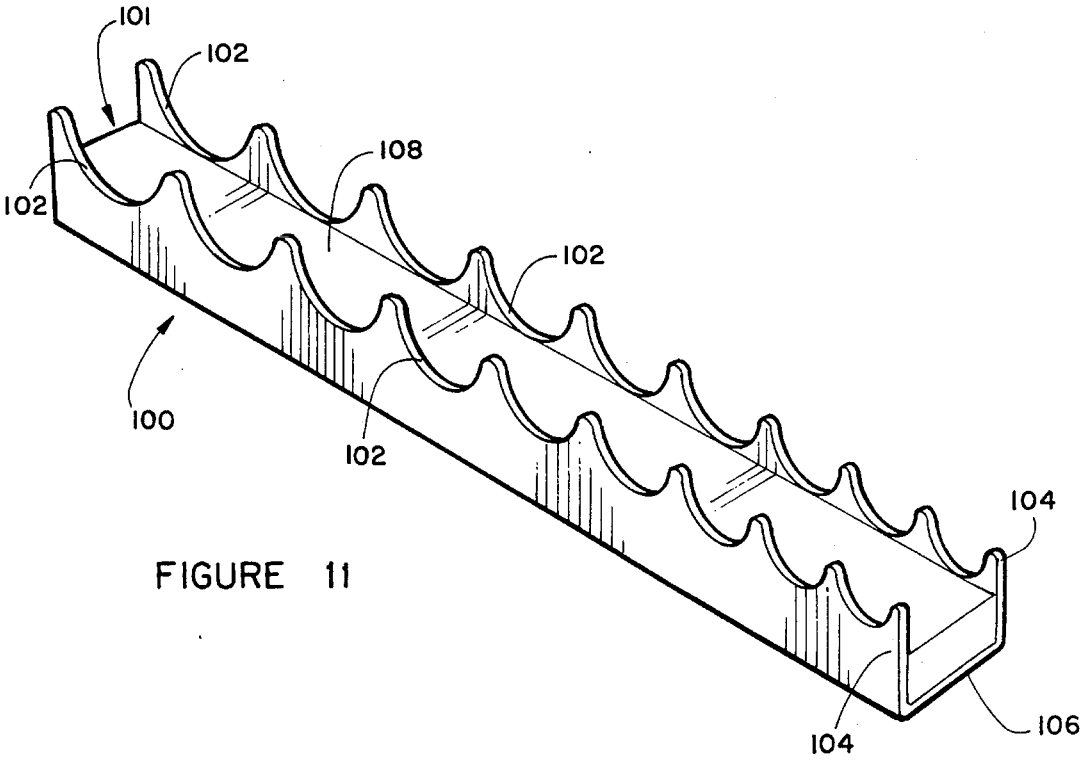
FIG. 11 is a perspective view of a fifth embodiment.

FIG. 11 shows another embodiment of the holder of this invention. Here, a generally U-shaped channel 100 of magnetic material has corresponding patterns of recesses 102 along each upstanding wall 104 of channel 100. Typically, recesses 102 are portions of circles, with the diameters increasing from one end of channel 100 to the other. An elongated magnet 101, preferably having a greater width than thickness, is mounted within channel 100, such as by adhesive bonding. In the embodiment of FIG. 11, the magnet has a lower surface 106 which is uniformly a single pole, either north or south. The upper surface 108 is uniformly the opposite pole. Any suitable magnetic material may be used in magnet 101, including flexible magnets, ceramic magnets and the like. Strong magnetic attraction is provided by magnet 101 in conjunction with the walls 104.

Figure 12:
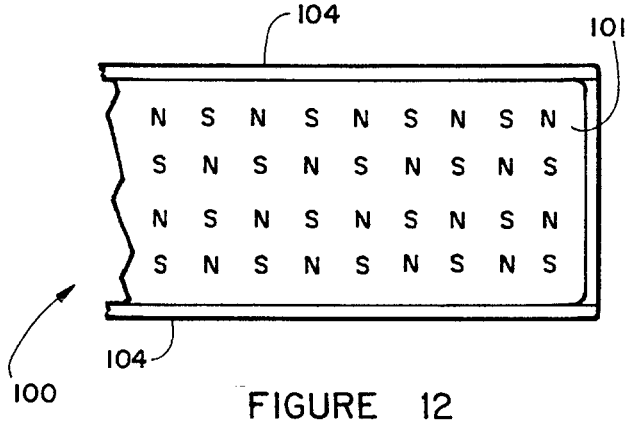
FIG. 12 is a plan view of a sixth embodiment.

FIG. 12 illustrates a variation on the embodiment of FIG. 11. Here magnet 101 within channel 100 has upper and lower surfaces magnetized with discrete north pole and south pole areas across the upper surface as schematically indicated by "N" and "S⇆, with the lower surface in each area having the opposite polarity. If desired, a narrow non-magnetized region may be provided between each adjacent north and south pole. This arrangement provides increased magnetic attraction across the magnet surface.

The holders of this invention significantly improve the visibility of socket heads or other tools when in place on the holder. The tools may be viewed both from the end and the side, making reading of size markings or other indicia convenient. The regular, sequential assembling of cylindrical tools by increasing (or decreasing) diameter makes selecting the correct size much easier. The ability to mount the holder in any position, including inverted under a shelf or the like makes access to the stored objects much more convenient. Also, the filled holder can be carried in a pocket or tool box without any significant chance that objects will be dislodged.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A holder for magnetic metal cylinders of regularly varying diameters which comprises:

an elongated member having a plurality of closely spaced partial-cylindrical transverse recesses along a first surface;

said partial-cylindrical recesses increasing in diameter along at least a portion of said first surface, said recesses having an inner surface;

an elongated magnet in engagement with said elongated member opposite said recesses;

a surface of said magnet positioned adjacent to said recesses and having alternate transverse north and south pole regions with an interface between each pair of regions;

said interface between adjacent surface north and south pole regions lying substantially in a plane including the axis of each recess and perpendicular to said elongated member; and a non-magnetized region having a thickness of from about 0.020 to 0.100 inch emplaced at said interface between each adjacent pair of north and south poles;

whereby a cylindrical object placed in a recess of corresponding diameter will be closely adjacent to said magnet along said interface between adjacent north and south poles.

2. The holder according to claim 1 wherein said member includes a continuous sheet of non-magnetic material in which said recesses are formed and further including an elongated transverse aperture in each recess whereby said magnet is closely adjacent to said inner surface of said recess at said aperture and said continuous sheet of non-magnetic material is bounded by side walls along each long side and end walls along each end.

3. The holder according to claim 1 wherein said magnet comprises a homogeneous material in which said alternate north and south poles are formed magnetically.

4. The holder according to claim 1 wherein said magnet is formed from a strip of magnetic material having north poles at one surface and south poles at a second, opposite, surface which has been transversely cut and reassembled with alternate north and south poles on each surface and portions of non-magnetic material are placed between adjacent north and south pole regions.

5. A holder for magnetic metal cylinders of regularly varying diameters which comprises:

an elongated member comprising a continuous sheet of nonmagnetic material at least partially formed into a plurality of closely spaced partial-cylindrical transverse recesses each having an inner and an outer surface;

said partial-cylindrical recesses regularly increasing in diameter;

an elongated magnet in engagement with said elongated member having a planar surface;

an elongated transverse aperture in each recess whereby said magnet is closely adjacent to said inner surface of said recess at said aperture;

a magnet surface toward said recesses having alternate transverse north and south pole regions;

including a non-magnetized region having a thickness of from about 0.020 to 0.100 inch at an interface between each adjacent pair of north and south pole regions; and said interface between adjacent north and south pole regions lying substantially in a plane including the axis of a recess and perpendicular to said elongated member;

whereby a cylindrical object placed in a recess of corresponding diameter will be substantially in contact with said magnet along said interface between adjacent north and south poles.

6. The holder according to claim 5 wherein said continuous sheet of non-magnetic material is bounded by side walls along each long side and end walls along each end and said magnet is positioned in a channel formed by side and end walls.

7. A holder for magnetic metal cylinders of regularly varying diameters which comprises:

an elongated member having a generally U-shaped channel configuration including spaced sidewalls and a bridging wall therebetween;

said sidewalls having a plurality of closely spaced, complementary, partial-cylindrical transverse recesses;

said partial-cylindrical recesses regularly increasing in diameter along at least a portion of said elongated member; and an elongated magnet positioned on said bridging wall.

8. The holder according to claim 7 wherein said elongated magnet has a first surface in contact with said bridging wall having a substantially uniform single magnetic polarity and a second surface opposite said first surface exposed between said sidewalls and having a polarity opposite to that of said first surface.

9. The holder according to claim 7 wherein said elongated magnet has a first surface in contact with said bridging wall and a second surface opposite said first surface exposed between said sidewalls, said first surface having a pattern of alternating north and south polarity regions and said second surface having a corresponding pattern of opposite polarity.

10. The holder according to claim 7 wherein non-magnetic regions are provided between said alternating north and south polarity regions.

11. The holder according to claim 7, further including:

a surface of said magnet adjacent to said recesses having two adjacent north and south pole regions;

a non-magnetized region having a thickness of from about 0.020 to 0.100 inch at said interface between each adjacent pair of north and south pole regions; and an interface between adjacent north and south pole regions lying substantially along the centerline of said elongated member.

12. The holder according to claim 11 wherein said magnet comprises a homogeneous material in which said adjacent north and south poles are formed magnetically.

13. The holder according to claim 11 wherein said magnet is formed from a strip of magnetic material having north poles at one surface and south poles at a second, opposite, surface which has been transversely cut and reassembled with adjacent north and south poles on each surface and said non-magnetic material therebetween.

14. The holder according to claim 11 further including means for securing a base to said channel opposite said recesses.

15. The holder according to claim 14 further including at least one additional magnet secured to said base for securing said holder to a magnetic metal structure.

16. A holder for magnetic metal cylinders of regularly varying diameters which comprises:

a corrugated magnetic metal backing plate having an alternating pattern of recesses and ridges;

a flexible magnet conforming to one surface of said backing plate and bonded thereto at least within each of said recesses;

said magnet having alternate transverse north and south pole regions with north poles of each region interfaces with south poles of a next adjacent region;

each interface positioned at a bottom of each of said recesses; and means for securing said holder to a support surface.

17. The holder according to claim 16, further including:

a non-magnetized region having a thickness of from about 0.020 to 0.100 inch at each said interface between each adjacent pair of north and south pole regions.

18. The holder according to claim 16 wherein said magnet has a thickness of from 0.1 to 0.2 inch.

19. The holder according to claim 16 wherein said magnet comprises a homogeneous material in which said alternate north and south pole regions are formed .magnetically.

20. The holder according to claim 16 wherein said magnet is formed from a strip of magnetic material having north poles at one surface and south poles at an opposite surface which has been transversely cut and reassembled with alternate north and south poles on each surface.

21. A holder for magnetic metal cylinders of regularly varying diameters which comprises:

an elongated solid, non-magnetic, body having a substantially flat first surface and a second, opposite, surface having a plurality of spaced transverse recesses;

a cavity in said elongated body at approximately a bottom of each of said recesses extending transverse to said elongated body;

a magnet assembly in each of said cavities;

each of said magnet assemblies comprising an assembly of two magnets, each having a north pole region at one surface and a south pole region at a second, opposite, surface, said north pole region of one magnet adjacent to said south pole region of a next magnet; and a resulting interface between said two magnets lying substantially transverse to said elongated body.

22. The holder according to claim 21 further including magnetic metal plates on each side of each said magnet assembly, generally parallel to said interface.

23. The holder according to claim 21, further including a non-magnetized region having a thickness of from about 0.020 to 0.100 inch at said interface between each adjacent pair of north and south pole regions.

* * * * *